US009194682B2

(12) United States Patent
Pisella et al.

(10) Patent No.: US 9,194,682 B2
(45) Date of Patent: Nov. 24, 2015

(54) SAFETY AND ARMING DEVICE FOR A PROJECTILE AND USING MICRO ELECTRO-MECHANICAL TECHNOLOGY

(75) Inventors: Christian Pisella, Beaucroissant (FR); Marjorie Trzmiel, Grenoble (FR)

(73) Assignee: NEXTER MUNITIONS, Versailles (FR)

( * ) Notice: Subject to any disclaimer, the term of this patent is extended or adjusted under 35 U.S.C. 154(b) by 130 days.

(21) Appl. No.: 13/176,415

(22) Filed: Jul. 5, 2011

(65) Prior Publication Data

US 2012/0000388 A1 Jan. 5, 2012

(30) Foreign Application Priority Data

Jul. 2, 2010 (FR) ..... 10 02813

(51) Int. Cl.
*F42C 15/00* (2006.01)
*F42C 15/34* (2006.01)

(52) U.S. Cl.
CPC ..... *F42C 15/34* (2013.01)

(58) Field of Classification Search
CPC ..... F42C 15/34
USPC ..... 102/221, 222, 147, 151, 152, 154, 247, 102/251, 252, 254
See application file for complete search history.

(56) References Cited

U.S. PATENT DOCUMENTS 6,064,013 A * 5/2000 Robinson ..... 200/61.53
6,321,654 B1 * 11/2001 Robinson ..... 102/251
6,765,160 B1 * 7/2004 Robinson ..... 200/61.45 R
7,051,656 B1 * 5/2006 Koehler et al. ..... 102/249
7,444,937 B2 * 11/2008 Magnan et al. ..... 102/254
7,493,858 B1 * 2/2009 Smith et al. ..... 102/222
7,530,312 B1 * 5/2009 Roesler et al. ..... 102/249
8,276,796 B2 * 10/2012 Nishisaka ..... B28D 1/222 225/93
2007/0101888 A1 * 5/2007 Magnan et al. ..... 102/254
2011/0147860 A1 * 6/2011 Robert et al. ..... 257/415

FOREIGN PATENT DOCUMENTS

EP 1 780 496 A1 5/2007
EP 2 077 431 A2 7/2009
FR 2 934 042 A1 1/2010

OTHER PUBLICATIONS

French Search Report in French Patent Application No. 1002813; dated Mar. 3, 2011 (with English-language translation).

* cited by examiner

*Primary Examiner* — Troy Chambers
*Assistant Examiner* — Benjamin Gomberg
(74) *Attorney, Agent, or Firm* — Oliff PLC

(57) ABSTRACT

The invention consists of a safety and arming device for a projectile and using micro electro-mechanical technology that incorporates at least three layers of substrate: a bottom, a top and at least one intermediate layer incorporating at least one mobile part with respect to the different layers of substrate wherein the bottom and top incorporate raised patterns, the raised patterns being evenly spaced over the bottom and the top such that the mobile part is always, when in movement, held immobile between the raised patterns of the bottom and those of the top, the raised patterns of the bottom being in contact with a lower face of the mobile part and the raised patterns of the top being in contact with an upper face of the mobile part.

13 Claims, 3 Drawing Sheets

SAFETY AND ARMING DEVICE FOR A PROJECTILE AND USING MICRO ELECTRO-MECHANICAL TECHNOLOGY

BACKGROUND OF THE INVENTION

1. Field of the Invention

The technical scope of the invention is that of safety and arming devices for projectiles, based on micro-electro-mechanical technology.

2. Description of the Related Art

The purpose of safety and arming devices (SAD) is to isolate the detonator and explosive load of a projectile and to enable these two components of the pyrotechnic train to communicate only (according to present-day standards such as STANAG 4157) when at least two distinct firing environment conditions appear.

Today research is being made into the production of these devices using MEMS (Micro Electro Mechanical Systems) technology which enables such devices to be miniaturized allowing them to be integrated into medium caliber projectiles, for example. The isolation between the detonator and the explosive load is more often than not made in the form of a plate, also called a screen, slider or barrier, which obstructs the slot by which these two components of the pyrotechnic train are made to communicate. Reference may be made to patent EP1780496 by which such a device is known.

These barriers able to stop a pyrotechnic effect are relatively thick with respect to the overall size of the MEMS safety and arming device. However, the scale at which the MEMS are produced means that the behavior of the mechanisms differs considerably from that of mechanisms made at the centimetric scale.

Thus, the phenomena of adhesion for thick parts becomes determining. At the MEMS scale, two plane surfaces brought into contact with one another adhere to one another relatively strongly thereby hindering relative movements in these planes. The problem arises in particular when the mobile element is in contact with the MEMS substrate.

The barrier is thus subjected to adhesion effects detrimental to the optimal, safe and reliable functioning of the SAD.

SUMMARY OF THE INVENTION

The invention proposes to overcome problems of adhesion of thick mobile parts of the barrier type by equipping the zones of the SAD in contact with the barrier with means to reduce adhesion and friction.

The proposed solution consists in strongly reducing the contact surfaces between the barrier and other mobile elements of the SAD that are in contact with the surfaces of the substrate.

The invention thus relates to a safety and arming device for a projectile and using micro electro-mechanical technology that incorporates at least three layers of substrate: a bottom, a top and at least one intermediate layer incorporating at least one mobile part with respect to the different layers of substrate, safety and arming device wherein the bottom and top incorporate raised patterns, the raised patterns being evenly spaced over the bottom and the top such that the mobile part is always, when in movement, held immobile between the raised patterns of the bottom and those of the top, the raised patterns of the bottom being in contact with a lower face of the mobile part and the raised patterns of the top being in contact with an upper face of the mobile part.

According to a first embodiment of this safety and arming device, the raised patterns are made in the form of at least two rails integral with the bottom and at least two rails integral with the top, such rails being parallel to each other and oriented longitudinally along the trajectory which the mobile element must follow.

According to a second embodiment of this safety and arming device, the raised patterns are made in the form of studs evenly spaced over all the surfaces of the bottom and top over which the mobile element passes.

According to one variant, the studs may be hemi-spherical in shape.

BRIEF DESCRIPTION OF THE DRAWINGS

The invention will become more apparent from the following additional description made with reference to the appended drawings, in which.

DETAILED DESCRIPTION OF PREFERRED EMBODIMENTS

Figure 1:
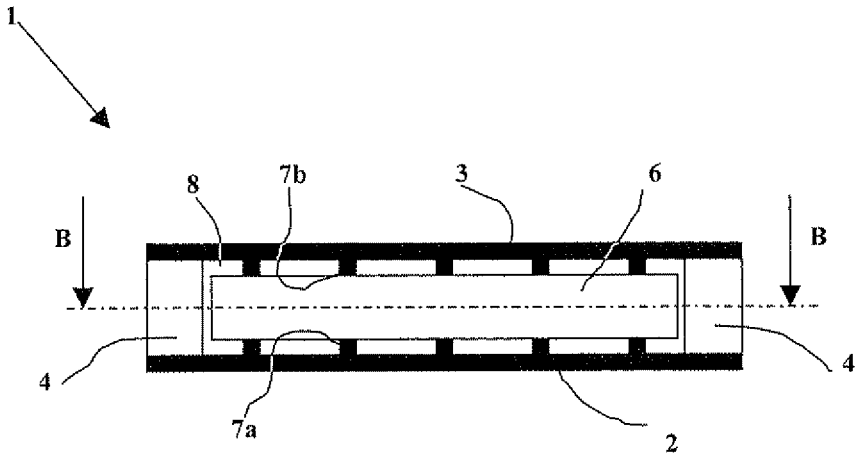
FIG. 1 shows a safety and arming device according to a first embodiment and according to a cross section view along plane AA, section plane which is marked out in FIG. 2.

FIG. 1 schematically shows a safety and arming device 1 using MEMS technology that incorporates three layers, namely a bottom 2, a top 3 and an intermediate layer 4. The device is pierced right through by a slot 5 (which can be seen in FIG. 2) intended to provide a passage for an element that will trigger the pyrotechnic train, such as an optical signal, for example. The intermediate layer 4 incorporates a frame 4*a* delimiting a rectangular cavity 8 in which there is a barrier which hereafter will be referred to as the mobile part 6.

This device is made using MEMS technologies, which are well known to persons skilled in the art, and thus implement the micro-machining or micro-engraving of a substrate (for example, silicon). In practical terms, the intermediate layer will be made separately and the mobile part 6 will be machined at the same time as the frame 4*a*.

The bottom 2 and top 3 will then be machined and the three layers 2, 3 and 4 will be bonded together. It is obvious that MEMS components are made using techniques similar to those used for integrated circuits. The device 1 is thus not made singly but at the same time as many others on a common support (generally called a wafer).

The assembly of the intermediate layer 4, the bottom 2 and the top 3 will be made simultaneously for several devices by assembling three wafers together. In this way, many devices are made simultaneously.

Naturally, temporary holding means (not shown) are provided between the mobile part 6 and the frame 4*a* so as to enable the positioning and assembling of the wafers on top of one another.

If a single device I is now considered, the bottom 2 of the device as well as the top 3 incorporate raised patterns 7*a* and 7*b* on their inner faces which play an anti-adhesion or anti-friction role. These raised patterns are in contact with the lower face of the mobile part 6 for the bottom 2 and with the upper face of the mobile part 6 for the top 3.

Figure 2:
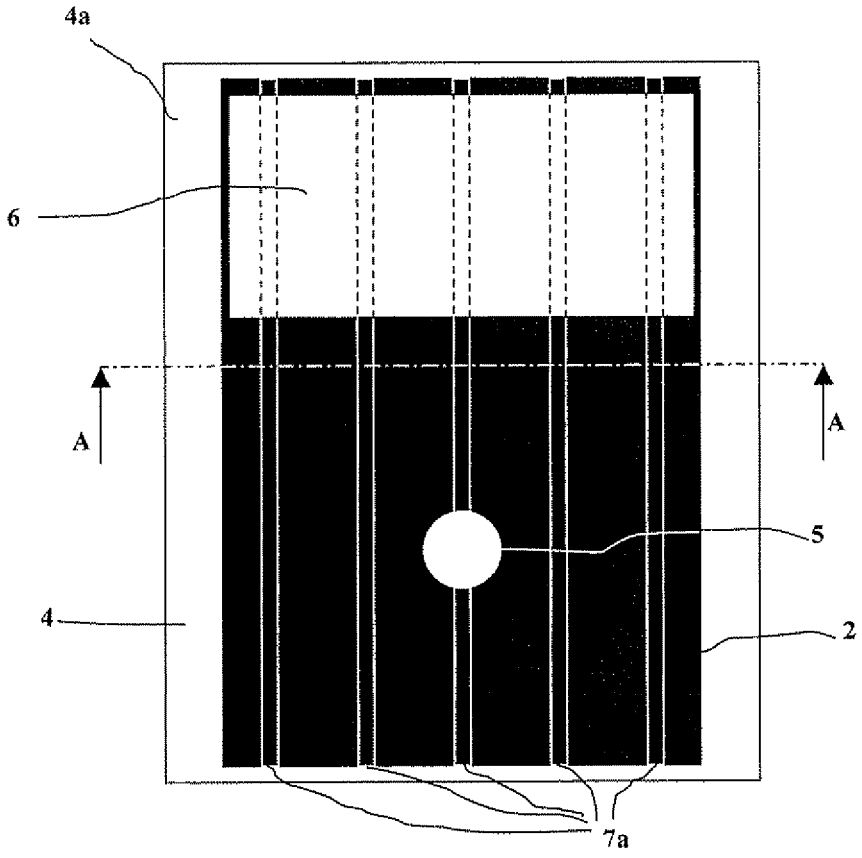
FIG. 2 shows a safety and arming device according to this first embodiment, device in its armed position, and shown as a longitudinal section along plane BB, section plane which is marked out in FIG. 1.

FIG. 2 shows the device 1 in its armed position, which is to say with the mobile part 6 uncovering the slot 5.

For the sake of the clarity of the presentation of the invention, the device shown here has been extremely simplified since only the mobile part 6 and the slot 5 are shown. Naturally, a full safety and arming device incorporates other means, such as motor means, locks and springs.

The subject of the presentation is not the full mechanism of such a device and reference may be made to patents EP1780495, EP1780496, EP2077431 and EP2932561 that describe such MEMS devices more fully. The movement of the mobile part may be obtained, for example, by micro-motor means (not shown), such as electrostatic combs.

According to this first embodiment, the anti-adhesion raised patterns are rails 7*a* and 7*b* having a square section which are placed in parallel to one another over the full length of the cavity 8 in the intermediate layer 4, length over which the mobile part 6 shall move.

Note that the total surface of the rails 7 in contact with the mobile part 6 is namely much less than the surface area of the upper and lower faces of the mobile part 6. Note also that the mobile part 6 is pinched between the rails 7*b* carried on the top 3 and the rails 7*a* carried on the bottom 2. The movement of the mobile part 6 is thus guided both by the bottom and top and the reduced contact surface considerably reduces the friction.

Note that the means provided by the invention enable the device to be positioned indifferently on its lower face, upper face or even on its side. The mobile part 6 is, in any event, held between the raised patterns 7*a* of the bottom and 7*b* of the top.

Figure 3:
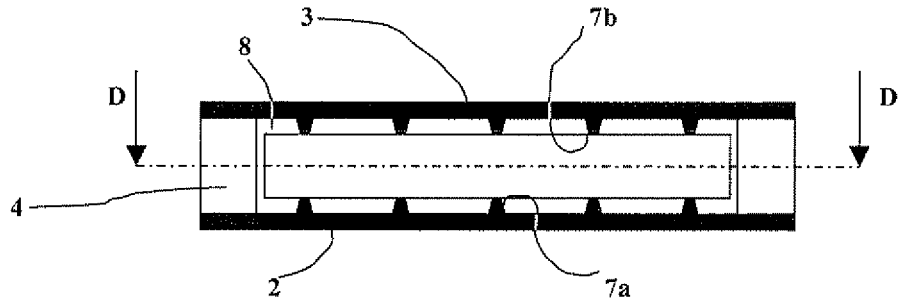
FIG. 3 shows the safety and arming device as a variant of the first embodiment shown as a cross section along plane CC, section plane which is marked out in FIG. 4.
Figure 4:
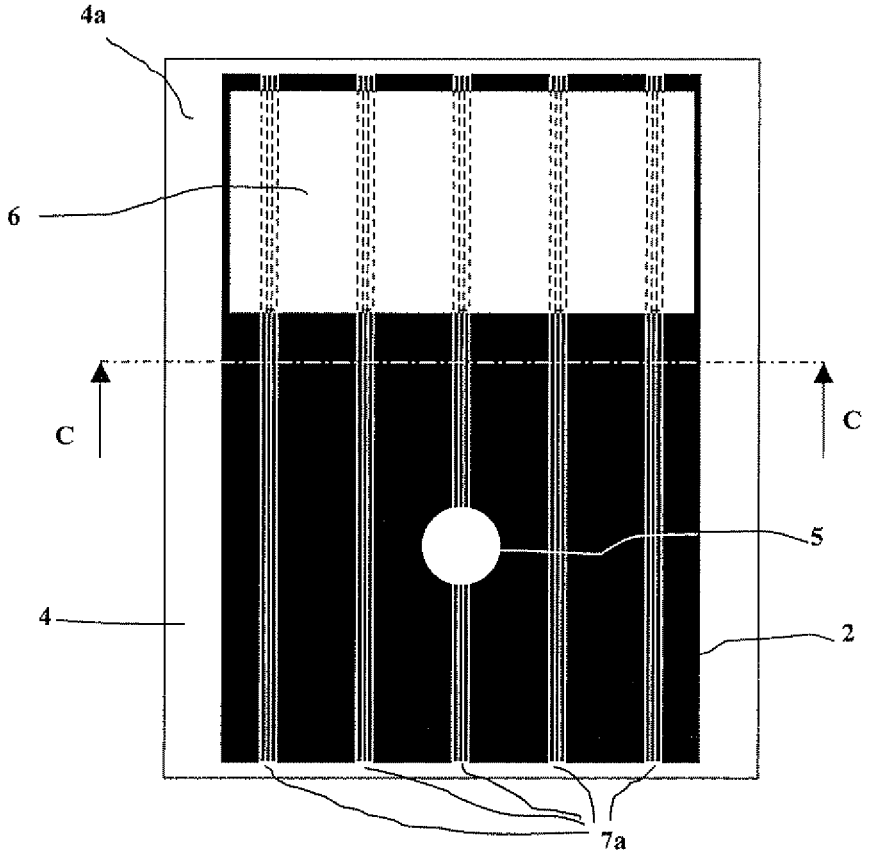
FIG. 4 shows this same variant of the safety and arming device as a longitudinal section view along plane DD, section plane which is market out in FIG. 3.

FIGS. 3 and 4 show a variant embodiment of the first embodiment in which the rails 7 are trapezoidal in section. It goes without saying that rails 7 with a triangular or semi-circular section can also be used (embodiments not shown).

In accordance with the invention, it is thus preferable for the mobile part 6, in all the positions it occupies during its movement, to be held immobile between the raised patterns 7*a* integral with the bottom 2 and the raised patterns 7*b* integral with the top 3.

It is easy for such an immobile position to be obtained with rails that extend the full length of the cavity 8 and which are evenly spaced over the width of this cavity.

With raised patterns of other shapes (as those to be described hereafter with reference to FIGS. 5 and 6), once again it merely requires their spacing to be such that the mobile part 6 is always held immobile between the raised patterns 7*a* integral with the bottom 2 and the raised patterns 7*b* integral with the top 3.

If these two support polygons still have a part in common (considering the geometrical projection of these two polygons on the plane of the mobile part), the mobile part is effectively held (or pinched) between the bottom 2 and the top 3.

In simple practical terms, the person skilled in the art will space the raised patterns evenly over all the surfaces of the bottom 2 and top 3 that receive the mobile part 6. The number and spacing of the raised patterns will depend on the dimensions of this mobile part 6.

Figure 5:
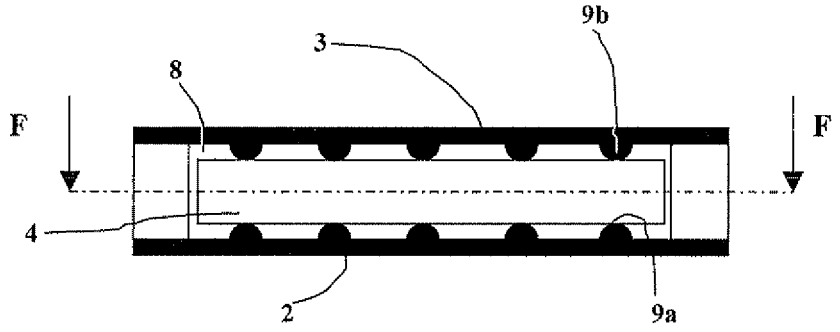
FIG. 5 shows the safety and arming device according to a second embodiment and shown as a cross section along plane EE, section plane which is marked out in FIG. 6.
Figure 6:
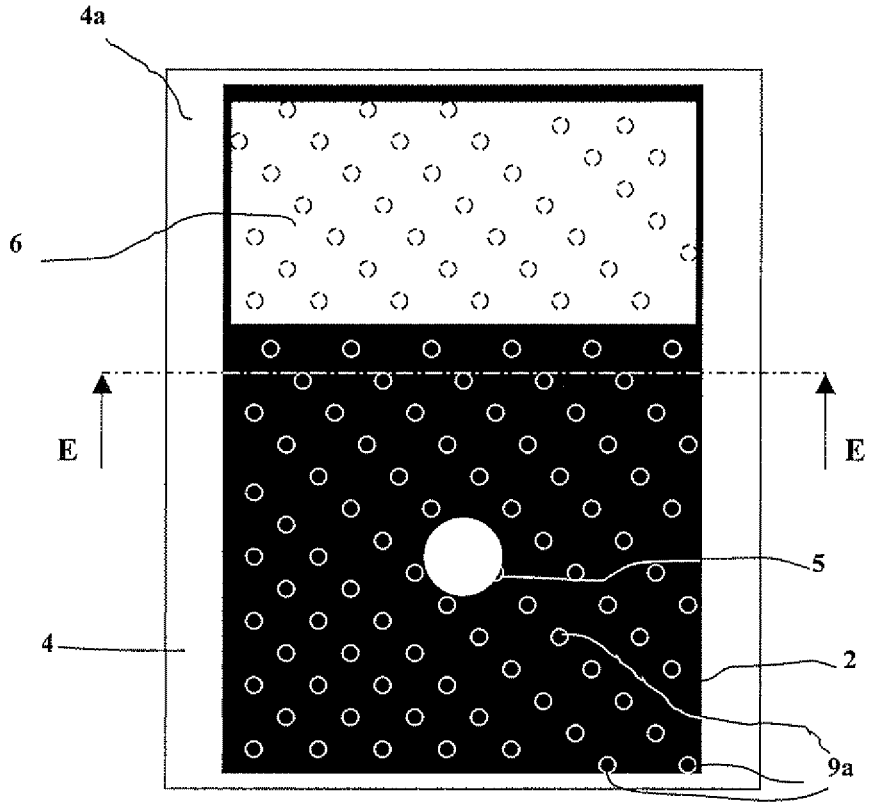
FIG. 6 shows this second embodiment as a longitudinal section along plane FF, section plane which is marked out in FIG. 5.

By way of example, FIGS. 5 and 6 show a device according to a second embodiment.

This mode differs from the previous one only in the structure of the anti-adhesion raised patterns which here are not rails but studs 9*a* and 9*b*, evenly spaced over all the surfaces of the bottom 2 and top 3 over which the mobile element 6 passes.

The studs are here in the shape of hemispheres and are evenly spaced over all the surface of the bottom 2 and top 3 in the same way as a rubber brush mat. Studs 9*a* are integral with the bottom 2 and studs 9*b* are integral with the top 3.

Note that the contact surface between the bottom 2, mobile part 6 and top 3 is limited to the points of tangency between the hemispheres and the mobile part 6.

It is naturally possible for the studs to be given different shapes: pyramidal, conical or tapered.

What is claimed is:

1. A micro electro-mechanical safety and arming device for a projectile, the device comprising:

a bottom substrate layer;

a top substrate layer; and at least intermediate substrate layer incorporating at least one cuboid mobile part; wherein:

said bottom layer includes a plurality of raised patterns configured to come into contact with a first face of the mobile part and said top layer includes a plurality of raised patterns configured to come into contact with a second face of the mobile part;

said raised patterns are arranged such that for each position of the mobile part, multiple raised patterns among the plurality of raised patterns of the bottom layer are in contact with said first face of the mobile part, while simultaneously multiple raised patterns among the plurality of raised patterns of the top layer are in contact with said second face of the mobile part;

said first face and second face are both external flat planar surfaces on opposite sides of the mobile part such that a normal direction of the first face is opposite of a normal direction of the second face;

said plurality of raised patterns of said bottom layer are evenly spaced over said bottom layer and said plurality of raised patterns of said top layer are evenly spaced over said top layer such that for each position of said mobile part, said mobile part is held stably between said plurality of raised patterns of said bottom layer and said plurality of raised patterns of said top layer while movement of the mobile part is guided along the plurality of raised patterns of said bottom and top layers; and wherein the amount of surface area of the first and second faces of the mobile part in contact with the plurality of raised patterns of the bottom and top layers, respectively, is less than the total surface area of the first and second faces of the mobile part, such that the surfaces of the first and second faces which are not in contact with the plurality of raised patterns of the bottom and top layers, respectively, are also not in contact with the bottom and top layers in order to prevent adhesion resulting from friction between the mobile part and the bottom and top layers.

2. A safety and arming device according to claim 1, wherein said raised patterns integral with said bottom layer include at least two rails parallel to each other and oriented longitudinally along a trajectory said mobile part must follow and said raised patterns integral with said top layer include at least two rails parallel to each other and oriented longitudinally along the trajectory said mobile part must follow.

3. A safety and arming device according to claim 2, wherein the bottom rails and the top rails are each configured to form flat planar surfaces that contact the mobile part.

4. A safety and arming device according to claim 1, wherein said raised patterns are made in the form of studs.

5. A safety and aiming device according to claim 4, wherein said studs are hemi-spherical in shape.

6. A safety and arming device according to claim 1, wherein the device is configured to guide the mobile part in a rectilinear manner.

7. A safety and arming device according to claim 1, wherein each of said raised patterns constitute a support configured to contact the mobile part according to a plane.

8. A safety and arming device according to claim 1, wherein the mobile part constitutes a barrier of the safety and arming device.

9. A safety and arming device according to claim 1, wherein the intermediate substrate further comprises a frame fixed to the bottom substrate layer and to the top substrate layer and delimiting a cavity in which the mobile part is arranged.

10. A safety and arming device according to claim 1, wherein, in a cross-sectional view showing an interface with the raised patterns, the first face and the second face are continuous flat planar surfaces along an entire width of the mobile part.

11. A safety and arming device according to claim 1, wherein, in a cross-sectional view showing an interface with the raised patterns, the mobile part has a rectangular cross-section.

12. A micro electro-mechanical safety and arming device for a projectile, the device comprising:

first and second substrate layers, each including a plurality of raised patterns; and a cuboid mobile part disposed between the first and second substrate layers, the mobile part having a first face in contact with multiple raised patterns among the raised patterns of the first substrate layer and a second face in contact with multiple raised patterns among the raised patterns of the second substrate layer for each position of the mobile part; wherein:

said plurality of raised patterns of said first substrate layer are configured to come into contact with said same first face of the mobile part and said plurality of raised patterns of said second substrate layer are configured to come into contact with said same second face of the mobile part;

said plurality of raised patterns of said bottom layer are evenly spaced over said bottom layer and said plurality of raised patterns of said top layer are evenly spaced over said top layer such that for each position of said mobile part;

the mobile part is suspended between the first and second substrate layers such that the mobile part cannot move in a first direction perpendicular to the first and second substrate layers but is free to move in a second direction parallel to the first and second substrate layers;

the first face and the second face are both flat external planar surfaces on opposite sides of the mobile part such that a normal direction of the first face is opposite of a normal direction of the second face; and wherein the amount of surface area of the first and second faces of the mobile part in contact with the plurality of raised patterns of the bottom and top layers, respectively, is less than the total surface area of the first and second faces of the mobile part, such that the surfaces of the first and second faces which are not in contact with the plurality of raised patterns of the bottom and top layers, respectively, are also not in contact with the bottom and top layers in order to prevent adhesion resulting from friction between the mobile part and the bottom and top layers.

13. A safety and arming device according to claim 12, wherein the second direction is rectilinear.

* * * * *